US005826755A

United States Patent [19]

Burd

[11] Patent Number: 5,826,755

[45] Date of Patent: Oct. 27, 1998

[54] LIQUID DISPENSER WITH SELECTABLY ATTACHABLE ACTUATOR

[75] Inventor: Wayne D. Burd, High Ridge, Mo.

[73] Assignee: Koller Enterprises, Inc., Fenton, Mo.

[21] Appl. No.: 695,228

[22] Filed: Aug. 7, 1996

Related U.S. Application Data

[63] Continuation-in-part of Ser. No. 574,260, Dec. 18, 1995, abandoned.

[51] Int. Cl.[6] ..... B65D 88/54

[52] U.S. Cl. ..... 222/309; 222/181.1; 222/321.8

[58] Field of Search ..... 222/214, 215, 222/309, 181.1, 185.1, 321.8

[56] References Cited

U.S. PATENT DOCUMENTS

| | | | |
|---|---|---|---|
| 2,554,570 | 5/1951 | Harvey | 222/207 |
| 3,124,275 | 3/1964 | Lake | 222/182 |
| 3,250,438 | 5/1966 | Packwood, Jr. | 222/309 X |
| 3,254,802 | 6/1966 | Barnes | 222/181 |
| 3,386,630 | 6/1968 | Haviland | 222/309 X |
| 3,828,985 | 8/1974 | Schindler | 222/207 |
| 3,945,060 | 3/1976 | Gargione | 4/228 |
| 3,952,918 | 4/1976 | Poitras et al. | 222/82 |
| 4,018,363 | 4/1977 | Cassia | 222/80 |
| 4,146,156 | 3/1979 | Cassia | 222/214 |
| 4,161,265 | 7/1979 | Hauser et al. | 222/181 |
| 4,279,364 | 7/1981 | Perez | 222/162 |
| 4,288,007 | 9/1981 | Rogers et al. | 222/66 |
| 4,324,348 | 4/1982 | Johnson et al. | 222/181 |
| 4,615,476 | 10/1986 | Hobbs et al. | 222/153 |
| 4,621,749 | 11/1986 | Kanfer | 222/153 |
| 4,634,022 | 1/1987 | O'Halloran et al. | 222/95 |
| 4,646,945 | 3/1987 | Steiner et al. | 222/207 |
| 4,673,109 | 6/1987 | Cassia | 222/153 |
| 4,705,195 | 11/1987 | Heck | 222/207 |
| 4,736,872 | 4/1988 | Ryder et al. | 222/94 |
| 4,747,520 | 5/1988 | Lane, Sr. | 222/181 |
| 4,828,150 | 5/1989 | Bottger et al. | 222/207 |
| 4,863,070 | 9/1989 | Andris | 222/207 |
| 4,978,036 | 12/1990 | Burd | 222/207 |
| 5,165,577 | 11/1992 | Ophardt | 222/181 |
| 5,183,182 | 2/1993 | Comstock et al. | 222/129 |
| 5,205,441 | 4/1993 | Andris | 222/207 |
| 5,238,156 | 8/1993 | Andris | 222/207 |
| 5,303,867 | 4/1994 | Peterson | 239/333 |
| 5,306,125 | 4/1994 | Weag | 417/472 |

*Primary Examiner*—Gregory L. Huson

*Attorney, Agent, or Firm*—Senniger, Powers, Leavitt & Roedel

[57] ABSTRACT

A dispenser for dispensing charges of a liquid from a container having a neck and a mouth at the end of the neck operable with the container in an inverted position for dispensing a charge of liquid. The dispenser includes a container holder for being mounted on a wall at one side of the holder constituting the back of the holder having a bottom with an opening therein for holding a container in an inverted position with its neck extending down through the opening. The dispenser further includes a member for being selectively pushed by hand toward the back of the holder or pulled by hand toward the front of the holder for actuating the dispenser. The actuator is selectively engageable with the container and with the holder in a first position for pushing the member toward the back of the holder to actuate the dispenser and in a second position for pulling the member toward the front to actuate the dispenser.

21 Claims, 7 Drawing Sheets

LIQUID DISPENSER WITH SELECTABLY ATTACHABLE ACTUATOR

CROSS-REFERENCE TO RELATED APPLICATION

This application is a continuation-in-part of application Ser. No. 08/574,260 filed Dec. 18, 1995 now abandoned.

BRIEF SUMMARY OF THE INVENTION

This invention relates generally to liquid dispensers and more particularly to dispensers of the type suitable for dispensing liquids such as soaps, hand cleaners and lotions. Such dispensers typically include a container holder mounted on a wall and a container held by the container holder and operated by a lever to dispense controlled amounts of liquid from the container. Such dispensers are often used in laboratories or workshops where space may be limited and access to a lever designed to operate in only one direction (e.g., pushed back in the direction toward the wall) for actuation of the dispenser may be difficult. Moreover, access to the dispenser may be required under conditions in which the user's hands are full and the operator can actuate the lever only by a pushing movement (or only by a pulling movement). Furthermore, it is desirable to be able to replace the container easily and quickly. Many liquid dispensers require partial disassembly of the holder to replace the container or require refilling of the container from a larger container.

Accordingly, among the several objects of this invention may be noted the provision of a liquid dispenser that is easily adaptable for dispensing liquid by actuation upon either pushing or pulling a lever; the provision of such a dispenser adapted for easy replacement of a container in the container holder thereof without any disassembly of the holder; and the provision of such a dispenser which is economical to manufacture and easy to use.

Generally, a dispenser of this invention is used for dispensing charges of a liquid from a container having a neck and a mouth at the end of the neck and having means at the mouth operable with the container in an inverted position for dispensing a charge of the liquid. It comprises a container holder for being mounted on a wall at one side of the holder constituting the back of the holder having a bottom with an opening therein for holding a container in an inverted position with its neck extending down through the opening, and means having a member for being selectively associated with the holder for being pushed by hand toward the back of the holder or pulled by hand toward the front of the holder for actuating the dispensing means. The actuating means is selectively engageable with the dispensing means and with the holder in a first position for pushing the member toward the back of the holder to actuate the dispensing means, and in a second position for pulling the member toward the front to actuate the dispensing means.

Other objects and features will be in part apparent and in part pointed out hereinafter.

BRIEF DESCRIPTION OF THE DRAWINGS

Corresponding parts are designated by corresponding reference numerals in the several views of the drawings.

DETAILED DESCRIPTION OF THE PREFERRED EMBODIMENT

Figure 1:
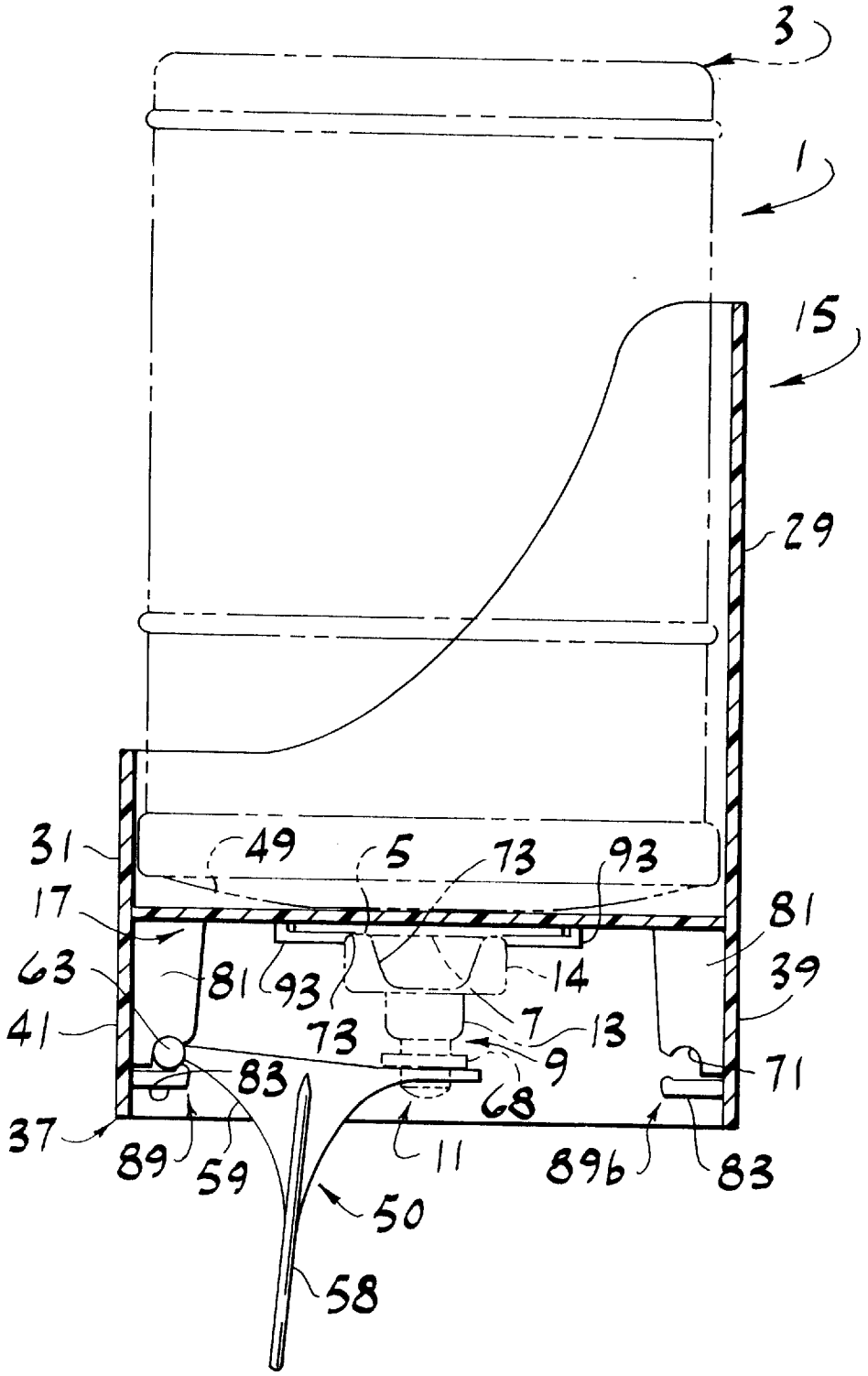
FIG. 1 is a view in side elevation with parts broken away and shown in section of a dispenser of the present invention having actuating means comprising a lever installed for actuation by a pushing movement, and showing in phantom a container in inverted position in the dispenser.

Referring to the drawings, first to FIG. 1, there is generally indicated at 1 a dispenser of this invention operable to dispense a liquid such as soap or lotion from a container 3 having a neck indicated at 5 and a mouth indicated at 7 at the end of the neck, and having means generally designated 9 at the mouth operable with the container in an inverted position for dispensing measured charges of the liquid. The dispensing means 9 comprises a pump having a part 11 movable in an upward direction relative to the inverted container through a pressure stroke for delivering a charge of liquid to the user and in a downward direction relative to the inverted container through a return stroke to a pump-recharging position, being shown in the latter position in FIGS. 1 and 2.

The pump 9 is of the type shown in the co-assigned U.S. Pat. No. 4,978,036 issued Dec. 18, 1990 entitled Dispensing Valve, this patent being incorporated herein by reference. It will suffice here to note that this pump 9, which is identified by the reference numeral 143 in said patent, comprises an elastomeric hollow body or bulb indicated at 13 herein (part 147 in said patent) adapted to be charged with liquid from the inverted container, having the aforesaid part designated 11 herein and constituting a nozzle assembly corresponding to that designated 151 in said patent associated therewith, and further having check valves associated with the arrangement such that on moving the part 11 upward with relation to the inverted container through a pressure stroke, the bulb 13 is squeezed to dispense through part 11 (i.e., the nozzle assembly) a charge of liquid. On release of the part 11 the bulb 13 expands downwardly under the inherent bias due to its being elastomeric and part 11 moves downwardly through a return stroke whereupon it is filled with liquid from the inverted container 3. Full details of the pump 9 may be ascertained from said patent. The container 3 and its neck 5 are generally cylindrical and the pump 9 is held in place at the mouth of the container by a cap 14 (181 in the aforesaid patent) threaded on the neck.

The dispenser 1 comprises a holder generally designated 15 comprising a receptacle for holding a container 3 in inverted position with the pump 9 at the lower end of the inverted container. The receptacle, which may be molded of a suitable plastic, has a flat bottom 17 having a portion 19 of somewhat less than full circular outline and a portion 21 narrower than the diameter of portion 19 extending outwardly from the latter in the direction toward what constitutes the back of the holder. Portion 19 has an outer edge 23 of circular outline and portion 21 has a straight outer edge 25, which may be referred to as the back edge of the bottom 17. Integral with the bottom 17 and extending upwardly therefrom is a peripheral receptacle wall structure designated in its entirety by the reference numeral 27 and having a flat back portion 29 extending upwardly from the straight back edge 25 of the bottom and a part-cylindric portion 31 extending upwardly from the edge 23 of the bottom. The part-cylindric portion 31 of the peripheral wall is of the same height as the flat back portion 29 of the peripheral wall where it merges with portion 29 as indicated at 33, and of relatively low height at the front of the holder as indicated at 35 so that it is largely open at the front for ready placement of a container 3 in the holder 15, while providing adequate support for the holder on the wall.

Integral with the bottom 17 and the peripheral wall structure 27 of the holder 15 and extending downwardly therefrom is a peripheral wall structure, which may be referred to as a skirt, designated in its entirety by the reference numeral 37, having a flat back portion 39 in downward continuation of the flat back portion 29 of the upper part of the holder and a part-cylindric portion 41 in downward continuation of the upper part-cylindric portion 31. The flat back portion 39 of the skirt 37 constitutes a downward extension extending downwardly from the bottom 17 of the holder 15 at the back of the holder and the part-cylindric portion 41 of the skirt constitutes a downward extension extending downwardly from the bottom of the holder at the front of the holder. The flat back portion 29 of the container holder 15 includes two holes each designated 45 and the flat back 39 of the skirt 37 includes two slots, each designated 47 for attaching the container holder 15 to a wall by screws or any other suitable means.

Figure 2:
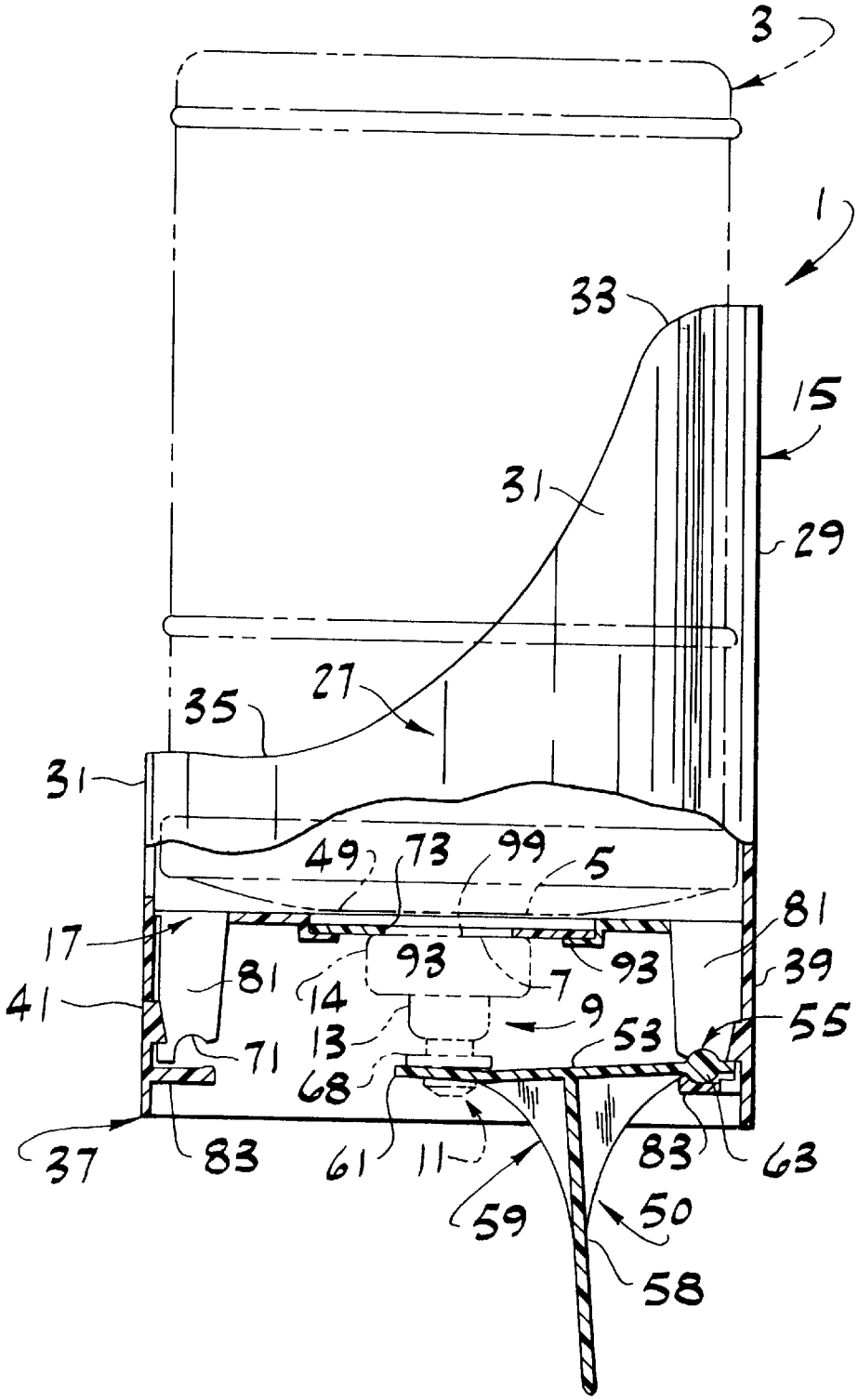
FIG. 2 is a view similar to FIG. 1 showing the lever installed for actuation by a pulling movement.
Figure 4:
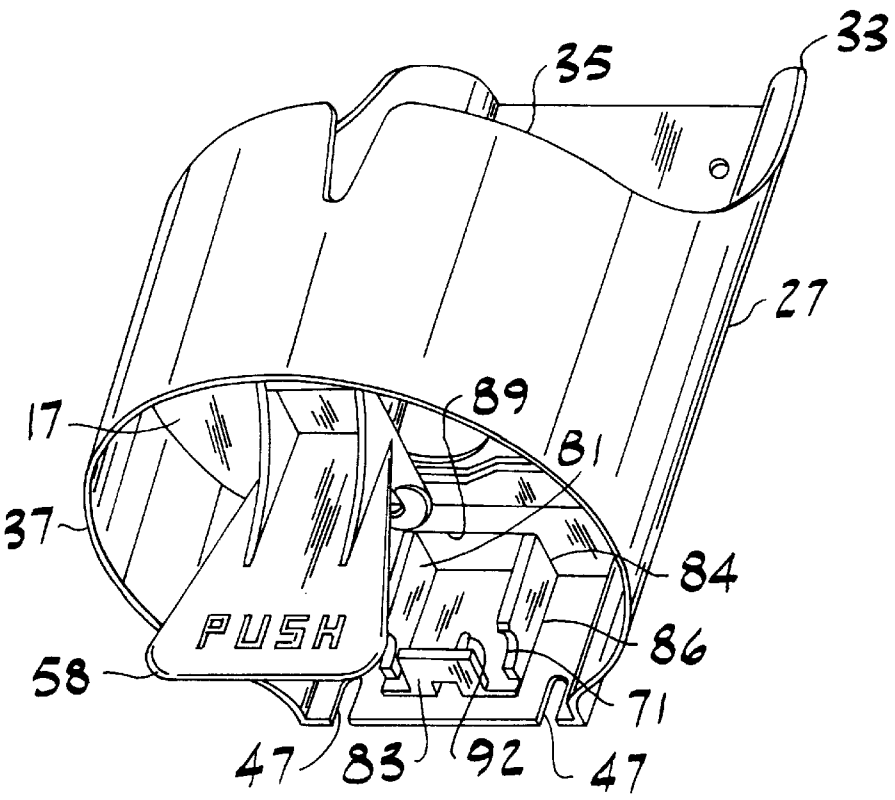
FIG. 4 is a bottom perspective of the dispenser of FIG. 2 without a container.
Figure 5:
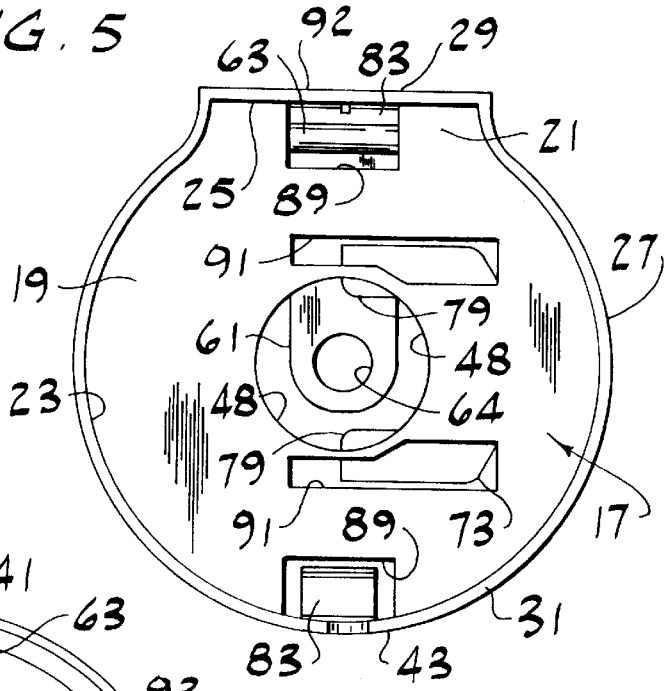
FIG. 5 is a top view of the dispenser of FIG. 1 omitting the container.
Figure 6:
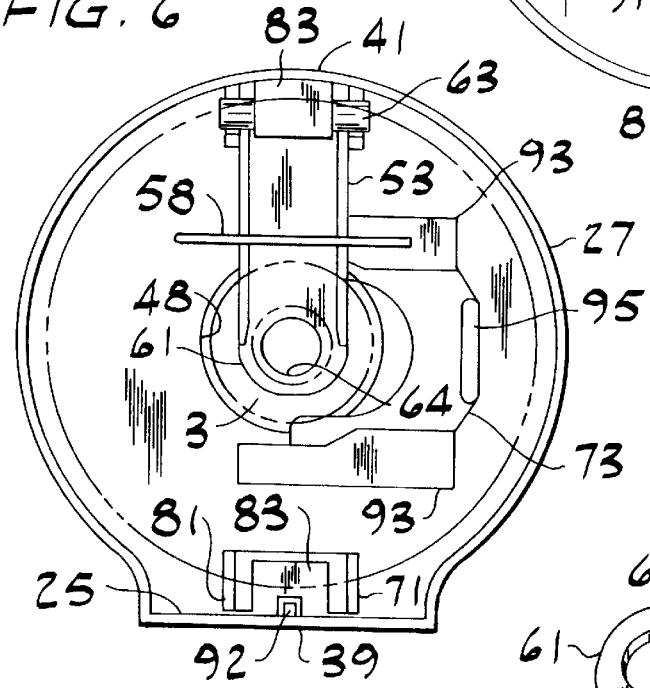
FIG. 6 is a bottom view of the dispenser of FIG. 2 omitting the container.

The bottom 17 of the container holder 15 has a circular central opening 48 therein for mounting a container 3 in the holder with the container in inverted position, with the shoulder 49 of the container leaning on the bottom 17 around the opening 9, with the neck 5 of the container extending down through the opening, and with the upper edge 99 of the cap 14 slightly below the level of the bottom 17 of the holder and with the bulb 13 and part 11 of the pump 9 below the cap. At 50 is generally indicated means for manually actuating the pump comprising a lever 53 having an operating arm 59. The lever 53 is selectively engageable with the moveable part 11 (the nozzle assembly) of the pump 9 and the front extension 41 with the container holder 15 in a first position (the position in which it is shown in FIGS. 1, 4 and 6) for pushing rearward the lever operating arm 59 to swing the lever in the direction to raise the moveable part 11 for delivery of a charge of liquid down through the nozzle assembly and in a second position, (the position in which it is shown in FIGS. 2 and 5) engaged with the moveable part 11 of the pump 9 and with the back extension 39 for pulling lever operating arm 59 forward to swing the lever 53 in the direction to raise the moveable part 11 in delivery of a charge of liquid down through the nozzle assembly.

Figure 7:
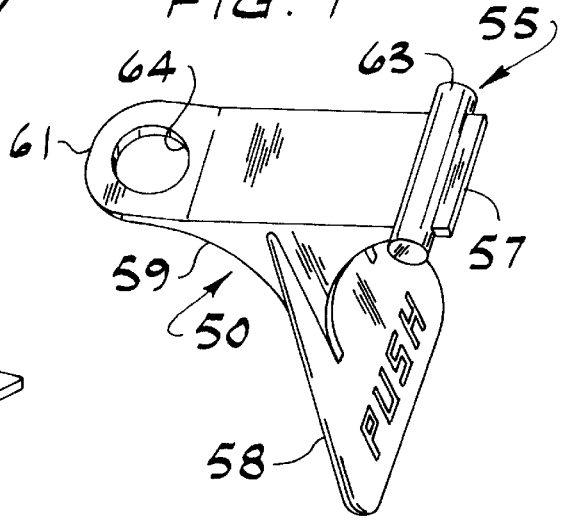
FIG. 7 is a perspective of a lever and push-pull member of the dispenser.
Figure 8:
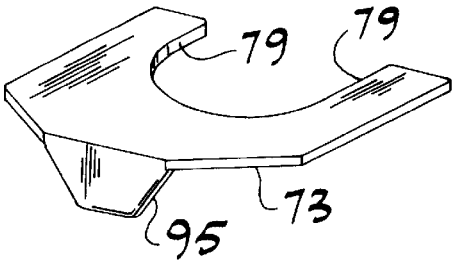
FIG. 8 is a perspective of a retaining clip of the dispenser.

The lever 53 includes pivot pin means 55 adjacent one end 57 therein for releasable interconnection with either of means indicated generally at 89 on the inside of the front downward extension 41 means indicated generally at **89*b* on the inside of the back downward extension 39, and releasably interconnectable at its other end 61 (referred to as its free end) with the moveable part 11 of the pump 9. The lever 53 is preferably molded of plastic to comprise a generally flat bar having the first means 55 molded integrally therewith adjacent the one end of the bar, the pin means being so formed as to provide a pin designated 63 extending laterally outwardly from the bar adjacent its said one end 57 (FIG. 7). The lever 53 is formed with a circular hole 64 adjacent its free end 61 for the releasable interconnection thereof with the moveable part 11 of the pump 9. The moveable part 11 is resiliently deformable for ease of installation of the lever 53. The moveable part 11 of the pump 9 includes a radially extending annular flange 68 engageable with the free end 61 of the lever for upward movement. The hole 64 formed in the free end 61 is sized to receive a portion of the moveable part 11 located below the annular flange 68. The length of the lever 53 is sized such that the moveable part must be deformed by bending the moveable part slightly towards the one end 57 of the lever to fit the moveable part 11 into the opening 64 in the free end 61 of the lever. The lever 53 is maintained on the moveable part 11** by a force exerted by the moveable part against the lever as it attempts to return to its original undeformed position.

Figure 3:
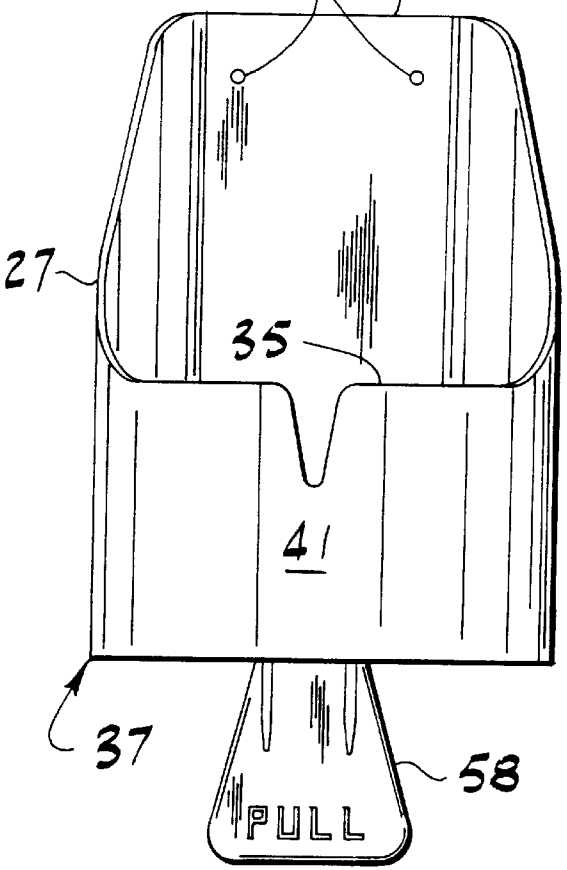
FIG. 3 is a view in front elevation of the dispenser of FIG. 1 without a container.

The operating arm 59 includes a push-pull member 58 for actuation of the lever 53 by an operator and preferably comprises a flat surface for ease of operation with the lever attached to the front downward extension 41 (for actuation by a pushing movement) or attached to the back downward extension 39 (for operation by a pulling movement). As shown in FIGS. 3 and 7, the push-pull member 58 may include markings to indicate whether the member is installed for a push or pull mode of operation. In operation, pushing on the push-pull member 58 (right to left as viewed in FIG. 2) causes the push-pull member to pivot clockwise which causes the lever 53 to push upward on the moveable part 11 to dispense liquid from the container 3. The lever 53 and push-pull member 58 are preferably integrally formed, but may also be made from separate pieces and attached together.

The back and front downward extensions 39, 41 each comprise means for removably receiving the pivot pin 63 and holding it for pivoting of the lever 53 on the axis of the pivot pin. The receiving means are resiliently moveable between an open position for insertion of the pivot pin 63 and a closed position for holding the pivot pin. As shown in FIG. 4, the receiving means comprises a bracket 80 having a web 82 secured to the inside of the respective extension and flanges 81 extending from sides of the web. The flanges 81 extend inwardly generally vertically and parallel to one another from the web 82. The web 82 is shaped to correspond to either the part-cylindric portion 41 (front downward extension) or the flat back 39 (back downward extension) and is connected to the respective extension. Each flange 81 has a lower end having a notch 71 formed therein for receiving the pivot pin 63, an upper edge 84 adjacent to the bottom 17 of the holder 15 and a side edge 86 connected to the web 82 (FIG. 4). The bottom 17 of the holder 15 includes an opening 89 extending between the flanges 81. The length of the flanges 81 correspond to the location of the bottom 17 of the container holder 15 and length of the container 3 such that the lever 53 is generally horizontal when interconnected with the moveable part 11 and the bracket 80. Extending inwardly from a lower edge of the web 82 is a resilient retainer 83 for releasably retaining the pivot pin 63 while permitting pivoting of the lever 53 on the axis of the pin. The retainer 83 is resiliently moveable between an open position for insertion of the pivot pin 63 in the notches 71 and a closed position for holding the pivot pin in the notches. The bracket 80 further comprises a lug 92 extending inwardly form the web 82 and interposed between the flanges 81. The lug 92 is located above the retainer 83 a distance generally corresponding to the diameter of the pivot pin 63 so that once the pin 63 is snapped into place between the lug 92 and retainer 83, the pivot pin is securely held in place. The flanges 81, web 82 and lug 92 may be formed as a bracket as described above, and attached to the container holder by glue or any other suitable attachment means, or the entire container holder including the flanges, retainer and lug may be integrally molded as a single unit.

The dispenser 1 further comprises a container retaining clip 73 for securing the container 3 to the container holder 15 in an inverted position with the shoulder 49 of the container leaning on the bottom of the holder. The container holder 15 includes means defining clip receiving grooves 91 on the bottom 17 of the holder for slidably receiving the container retaining clip 73. The clip receiving grooves 91 are defined by opposing flanges 93 depending from the bottom 17 of the container holder 15. The container retaining clip 73 is sized and shaped for engaging the upper edge 99 of the cap 14 to prevent upward movement of the container 3 relative to the container holder 15 when the container retaining clip is inserted in the clip receiving grooves 91. The retaining clip 73 is generally U-shaped, having two legs 79 and a head 74 connecting the two legs. With the container 3 inserted in the holder 15 and the retaining clip 73 in the grooves 91, the legs 79 of the clip extend partially around the neck 5 of the container between the cap 14 and the container to prevent upward movement of the container relative to the container holder. The retaining clip 73 further comprises a downward extending lip 95 extending from an edge of the retaining clip opposite the legs 79. The lip 95 is provided for the user to hold onto for easy insertion or removal of the retaining clip 73. To replace an empty container 3, the clip 73 is slid along the flanges 93 in the container holder 15 away from the container so that the container can be pulled upward out of the holder. The lever 53 must first be disconnected from the moveable part 11 before removing the container 3. A new container 3 is then inserted into the container holder 15 and the retaining clip 73 is slid back into the grooves 91 in the bottom 17 of the container holder 15. The one piece retaining clip 73 allows for quick and simple replacement of an empty container.

Figure 9:
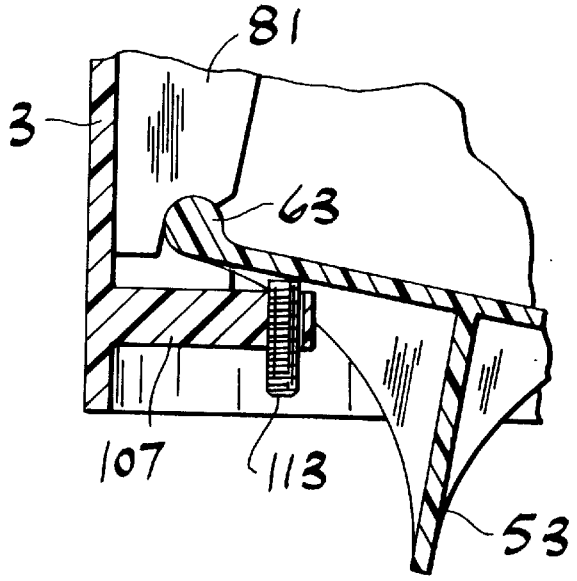
FIG. 9 is a partial cross-sectional view of a liquid dispenser of the present invention having an adjustment device.
Figure 10:
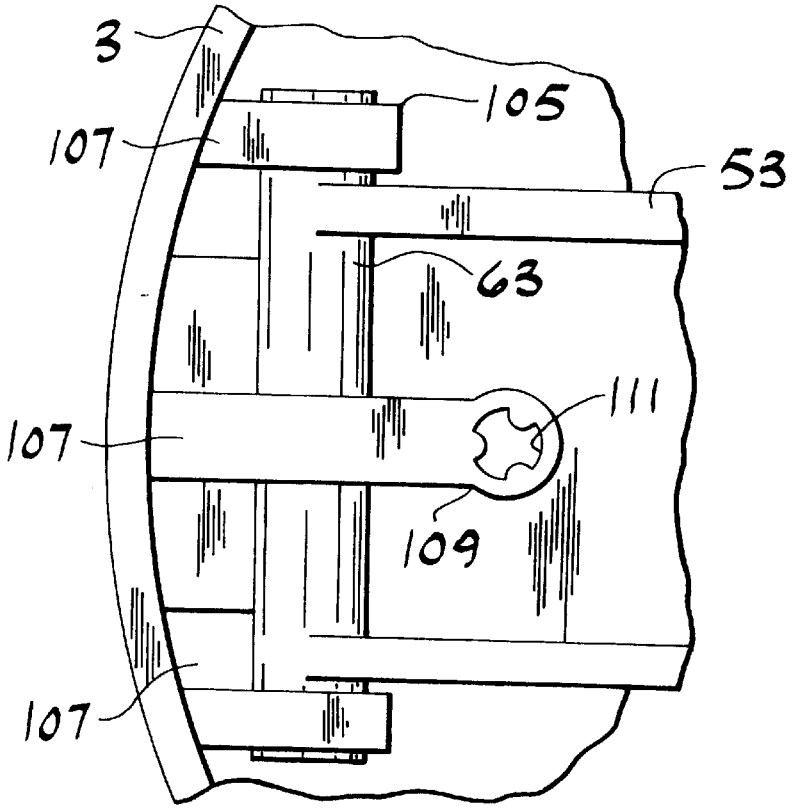
FIG. 10 is a bottom view of the liquid dispenser of FIG. 9 with a portion of the adjustment device removed.

Referring now to FIGS. 9 and 10, a liquid dispenser having means for limiting the amount of charge is shown. The dispenser includes a lever 53 for actuating the pump 9 as described above. The lever 53 is engageable with the moveable part 11 of the pump 9 at one end thereof and engageable with means for receiving the lever at the other end thereof for pivoting the lever for up and down swinging movement (FIGS. 1 and 2). The means for receiving the lever comprises a pair of flanges 81 extending inwardly generally vertically and parallel to one another from the container and a resilient retainer 105 extending inwardly from the container 3 below the lower ends of the flanges for releasably retaining one end of the lever 53. The resilient retainer 105 includes is resiliently moveable between an open position for insertion of the pivot pin 63 as described above. The resilient retainer 105 includes three arms 107 extending inwardly from the container 3. The center arm 109 includes means for limiting the lever 53 so that the amount of charge is reduced. The limiting means includes an opening 111 in the center arm 109 and an adjustable limiting stop 113 received in the opening. The stop 113 includes external threads and has a length sufficient to extend through the opening 111 and contact the lever 53 to limit the length of the pressure stroke of the pump, thus varying the amount of liquid delivered during the pressure stroke. The center arm 109 is preferably formed from a plastic material so that internal threads can be cut into the opening upon insertion and rotation of the stop 113. In order to reduce the amount of charge, the stop 113 is rotated until the stop extends from the top side of the upper surface of the center arm 109 to limit the movement of the lever. To increase the amount of the charge the stop 113 is rotated in the opposite direction so that the stop does not extend beyond the upper surface of the center arm, thus allowing full movement of the lever. It is to be understood that the number of arms 107 of the receiving means and the shape of the limiting stop 113 vary without departing from the scope of this invention. The adjustable limiting stop 113 may extend from the front extension 41 of the container 3, the back extension 39 or both.

Figure 11:
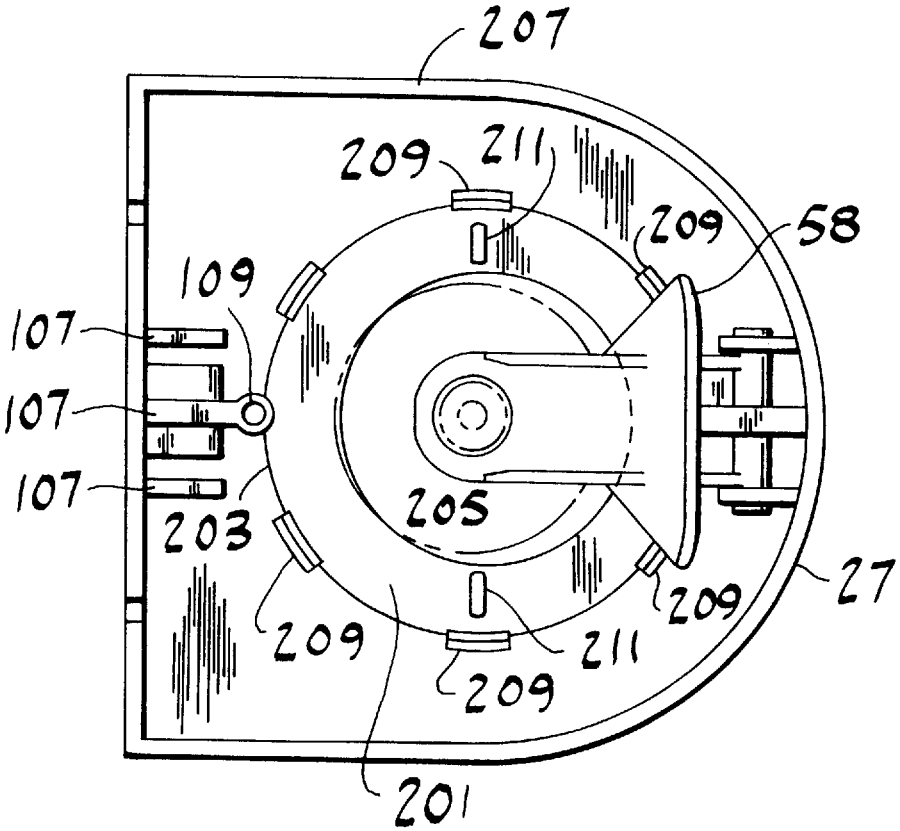
FIG. 11 is a bottom view of a second embodiment of the present invention.
Figure 12:
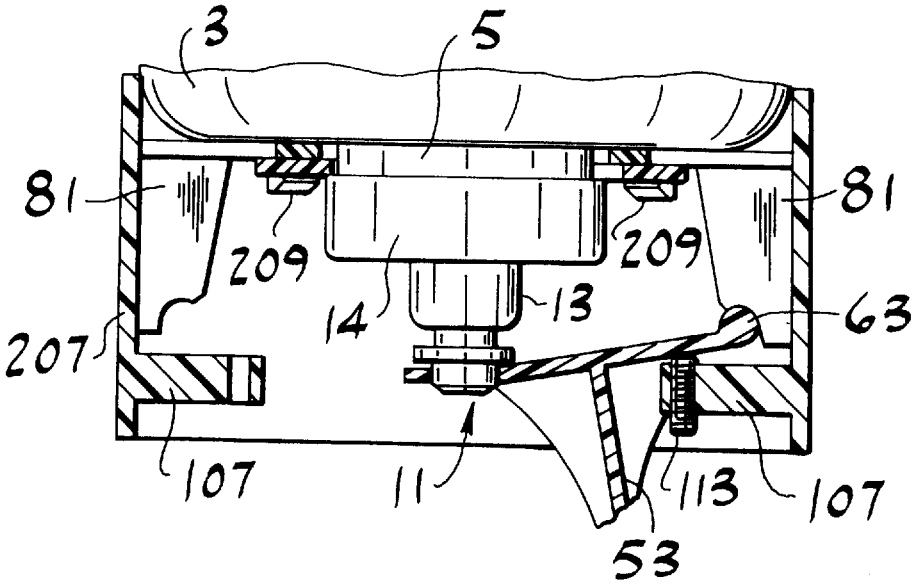
FIG. 12 is a view in side elevation with parts broken away and shown in section of a dispenser of FIG. 11.
Figure 13:
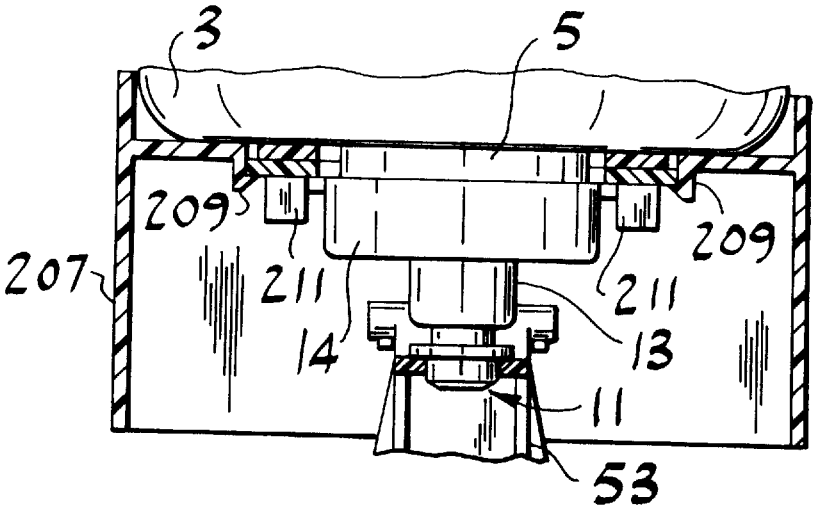
FIG. 13 is a view in front elevation of the dispenser of FIG. 11 with parts broken away and shown in section.

A second embodiment of this invention is shown in FIGS. 11–13. The dispenser is substantially the same as the first embodiment except for the retention of the bottle in the holder. The same reference numerals are used to identify corresponding parts of the dispenser of the second embodiment. The dispenser 200 includes a retainer in the shape of a ring 201. The ring 201 has an outer generally circular periphery 203 and an inner generally circular periphery 205 which is eccentric with respect to the outer periphery. The bottle holder 207 includes flanges 209 for holding the ring 201 in place. The ring 201 further includes tabs 211 for grasping the ring for rotation from a first position, (FIG. 12), in which the container 3 is prevented from being lifted out of the holder to a second position, (FIG. 13), in which the container is free to be lifted out of holder for replacement. In its first position, the inner periphery 205 of the ring 201 engages the neck 5 of the container 3 above the cap 14. As shown in FIG. 12, a portion of the ring 201 is located above the cap 14, thus preventing the container 3 from being removed from the holder 207. Upon rotation of the ring approximately 180 degrees, (FIG. 13), the inner periphery 205 is moved away from the neck 5 and allows for upward movement of the cap 14 beyond the ring 201 so that the container 3 may be removed from the holder 207. It is to be understood that shapes other than a ring may be used and that the first position and second position may be located at different angular positions relative to one another without departing from the scope of this invention.

In view of the above, it will be seen that the several objects of the invention are achieved an other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A dispenser for dispensing charges of a liquid from a container having a neck and a mouth at the end of the neck and having means at the mouth operable with the container in an inverted position for dispensing a charge of the liquid, said dispenser comprising:

a container holder for being mounted on a wall at one side of the holder constituting the back of the holder having a bottom with an opening therein for holding a container in an inverted position with its neck extending down through the opening; and means having a member for being selectively pushed by hand toward the back of the holder or pulled by hand toward the front of the holder for actuating said dispensing means;

said actuating means being selectively engageable with said dispensing means and with said holder in a first position for pushing said member toward the back of the holder to actuate said dispensing means and in a second position for pulling said member toward the front to actuate said dispensing means.

2. A dispenser as set forth in claim 1 wherein said dispensing means comprises a pump having a part moveable in an upward direction relative to the inverted container through a pressure stroke for delivering a charge of liquid to the user and in a downward direction relative to the inverted container through a return stroke to a pump-recharging position and being biased downward toward the latter position and wherein, with said actuating means in its said first position, pushing said member toward the back of the holder moves said pump part upward and, with said actuating means in its said second position, pulling said member toward the front of the holder moves said pump part upward.

3. A dispenser as set forth in claim 2 wherein said actuating means comprises a lever being engageable with the moveable part of the pump at one end thereof and engageable with one or the other of said downward extensions at the other end thereof for pivoting the lever for up and down swinging movement and a push-pull member extending down from the lever.

4. A dispenser as set forth in claim 3 wherein the container holder has extensions extending downwardly from its bottom at the front part and back thereof, and said lever has pivot pin means at said other end thereof constituting its outer end; each extension having on the inside thereof means for removably receiving said pivot pin means and holding it for pivoting of the lever on the axis of the pivot pin means.

5. A dispenser as set forth in claim 4 wherein each of the means for receiving the pivot pin means has notches for receiving the pivot pin means and means for retaining the pivot pin means in the notches, said retaining means being resiliently moveable between an open position for insertion of the pivot pin means in the notches and a closed position for holding the pivot pin means in the notches.

6. A dispenser as set forth in claim 5 wherein each pivot pin receiving means comprises a pair of flanges extending inwardly generally vertically and parallel to one another from the respective extension, each flange having a lower end with a notch therein, the pin means being receivable in said notches, said retaining means comprising a resilient retainer extending inwardly from the respective extension below the lower ends of the flanges for releasably retaining said pin means and permitting pivoting of the lever on the axis of the pin means.

7. A dispenser as set forth in claim 4 wherein each of said means for receiving the pivot pin means comprises a bracket having a web secured to the inside of the respective extension and flanges extending from the sides of the web; each flange having a notch at a lower edge thereof for receiving the pivot pin means, and a resilient retainer extending inward from the web resiliently moveable between an open position for insertion of the pin means in the notches and a closed position for holding the pivot pin means in the notches.

8. A dispenser as set forth in claim 3 wherein said moveable part is resiliently deflectable for interconnection of the lever with the moveable part and one or the other of said extensions.

9. A dispenser as set forth in claim 8 wherein said moveable part of the pump has a radially outwardly extending annular flange engageable by said one end of the lever for being moved upward on upward swing of the lever.

10. A dispenser as set forth in claim 9 wherein said one end of the lever has a hole formed therein adapted for receiving a portion of the moveable part disposed below said annular flange.

11. A dispenser as set forth in claim 1 further comprising a container retaining clip for securing the container to the container holder in an inverted position with the shoulder of the container bearing on the bottom of the holder.

12. A dispenser as set forth in claim 11 further comprising means defining clip receiving grooves on the bottom of the holder slidably receiving the clip.

13. A dispenser as set forth in claim 12 wherein said container has a cap and the container retaining clip is sized and shaped for engaging said cap to prevent upward movement of the container relative to said container holder when said container retaining clip is inserted in the clip receiving grooves.

14. A dispenser as set forth in claim 13 wherein said retaining clip includes a pair of spaced apart legs for engaging said cap.

15. A dispenser as set forth in claim 14 wherein said container retaining clip includes a downward extending lip for removing said retaining clip from the clip receiving groove.

16. A dispenser as set forth in claim 1 wherein said front and back downward extension means are formed by a skirt integral with and extending down from the bottom of the container holder.

17. A dispenser as set forth in claim 1 further comprising means for limiting the charge.

18. A dispenser for dispensing charges of a liquid from a container having a neck and a mouth at the end of the neck and having means at the mouth operable with the container in an inverted position for dispensing a charge of the liquid, said dispenser comprising:

a container holder for being mounted on a wall at one side of the holder constituting the back of the holder having a bottom with an opening therein for holding a container in an inverted position with its neck extending down through the opening;

said container having closure means for the mouth thereof, said closure means having a shoulder facing toward a bottom end of the container and having a diameter larger than a diameter of the neck; and a container retaining ring for securing the container to the container holder in an inverted position, said retaining ring having an outer generally circular periphery and an inner generally circular periphery with the inner periphery eccentric with respect to the outer periphery, the ring having a first position in which said inner periphery engages the neck of the container so that the container is in a locked position whereby the closure means is prevented from being moved upward past the ring, and a second position in which the closure means is free to move upward beyond the ring so that the container can be removed from the holder.

19. A dispenser as set forth in claim 18 wherein said ring further comprises at least one tab for grasping the ring and rotating the ring from the first position to the second position and back to the first position.

20. A dispenser for dispensing charges of a liquid from a container having a neck and a mouth at the end of the neck and having means at the mouth operable with the container in an inverted position for dispensing a charge of the liquid, said dispenser comprising:

a container holder for being mounted on a wall at one side of the holder constituting the back of the holder having a bottom with an opening therein for holding a container in an inverted position with its neck extending down through the opening;

means having a member for actuating said dispensing means;

means for limiting said actuating means such that the amount of charge is reduced; and said dispensing means comprising a pump having a part moveable in an upward direction relative to the inverted container through a pressure stroke for delivering a charge of liquid to the user and in a downward direction relative to the inverted container through a return stroke to a pump-recharging position and being biased downward toward the latter position, said actuating means comprising a lever engageable with the moveable part of the pump at one end thereof and engageable with means for receiving the lever at the other end thereof for pivoting the lever for up and down swinging movement, said limiting means comprising an adjustable limiting stop for the lever.

21. A dispenser as set forth in claim 20 wherein the means for receiving the lever comprises a pair of flanges extending inwardly generally vertically and parallel to one another from the container and a resilient retainer extending inwardly from the container below the lower ends of the flanges for releasably retaining one end of the lever, and wherein the limiting means comprises an adjustment device extending through an opening in the resilient retainer for engagement with the lever so that the length of the pressure stroke is limited to vary the amount of liquid delivered during the pressure stroke.

* * * * *